US009607749B2

(12) United States Patent
Cook et al.

(10) Patent No.: US 9,607,749 B2
(45) Date of Patent: Mar. 28, 2017

(54) SPLIT CORE CURRENT TRANSFORMER

(71) Applicant: Veris Industries, LLC, Tualatin, OR (US)

(72) Inventors: Martin Cook, Tigard, OR (US); Randall Brant Elliott, Tigard, OR (US); Gregory P. Dolim, Tigard, OR (US)

(73) Assignee: Veris Industries, LLC, Tualatin, OR (US)

( * ) Notice: Subject to any disclaimer, the term of this patent is extended or adjusted under 35 U.S.C. 154(b) by 0 days.

(21) Appl. No.: 14/602,971

(22) Filed: Jan. 22, 2015

(65) Prior Publication Data

US 2015/0206645 A1 Jul. 23, 2015

Related U.S. Application Data

(60) Provisional application No. 61/930,830, filed on Jan. 23, 2014.

(51) Int. Cl.

| | |
|---|---|
| ***H01F 38/20*** | (2006.01) |
| ***H01F 27/24*** | (2006.01) |
| ***H01F 27/02*** | (2006.01) |
| ***H01F 27/26*** | (2006.01) |
| ***H01F 38/30*** | (2006.01) |

(52) U.S. Cl.

CPC ..... *H01F 27/02* (2013.01); *H01F 27/263* (2013.01); *H01F 38/30* (2013.01)

(58) Field of Classification Search

CPC ..... H01F 27/02; H01F 27/24; H01F 27/263; H01F 38/30; H01F 38/28; H01F 17/06; H01F 17/062

USPC ..... 336/216, 213, 173–176, 90

See application file for complete search history.

(56) References Cited

U.S. PATENT DOCUMENTS

| | | | |
|---|---|---|---|
| 1,100,171 | A | 6/1914 | Brown |
| 1,455,263 | A | 5/1923 | Oberfell |
| 1,569,723 | A | 1/1926 | Dickinson |
| 1,800,474 | A | 4/1931 | Scherer |
| 1,830,541 | A | 11/1931 | Harris |
| 1,871,710 | A | 8/1932 | Lenehan |
| 2,059,594 | A | 11/1936 | Massa, Jr. |
| 2,411,405 | A | 11/1946 | Yuhas |
| 2,412,782 | A | 12/1946 | Palmer |
| 2,428,613 | A | 10/1947 | Boyajian |
| 2,428,784 | A | 10/1947 | Cole |
| 2,512,070 | A | 6/1950 | Nelsen et al. |
| 2,663,190 | A | 12/1953 | Ilgenfritz |
| 2,746,295 | A | 5/1956 | Lubkin |
| 2,802,182 | A | 8/1957 | Godshalk et al. |
| 2,852,739 | A | 9/1958 | Hansen |

(Continued)

*Primary Examiner* — Mangtin Lian

(74) *Attorney, Agent, or Firm* — Chernoff Vilhauer McClung & Stenzel, LLP

(57) ABSTRACT

A sensing transformer includes a first transformer segment including a first magnetically permeable core having a sector having a planar cross-section bounded by a closed curve and having a first end and a second end. The first core includes a winding including at least one turn substantially encircling the cross-section of the core and a first segment housing enclosing the winding and a portion of the first core. A second transformer segment separable from the first transformer segment including a second magnetically permeable core having another sector having a third end and a fourth end.

14 Claims, 5 Drawing Sheets

(56) References Cited

U.S. PATENT DOCUMENTS

| | | | |
|---|---|---|---|
| 2,943,488 | A | 7/1960 | Strobel et al. |
| 3,190,122 | A | 6/1965 | Edwards |
| 3,243,674 | A | 3/1966 | Ebert |
| 3,287,974 | A | 11/1966 | Clemochowski |
| 3,374,434 | A | 3/1968 | Perry |
| 3,493,760 | A | 2/1970 | Hoadley |
| 3,512,045 | A | 5/1970 | Tipton et al. |
| 3,584,294 | A | 6/1971 | Siwko |
| 3,593,078 | A | 7/1971 | Domshy |
| 3,696,288 | A | 10/1972 | Carman |
| 3,728,705 | A | 4/1973 | Atkins |
| 3,769,548 | A | 10/1973 | Pardue |
| 3,772,625 | A | 11/1973 | Raupach |
| 3,861,411 | A | 1/1975 | Mitchell et al. |
| 3,955,701 | A | 5/1976 | Fisch |
| 3,976,924 | A | 8/1976 | Vanjani |
| 4,001,647 | A | 1/1977 | Klein et al. |
| 4,001,758 | A | 1/1977 | Esper et al. |
| 4,007,401 | A | 2/1977 | Kimmel et al. |
| 4,030,058 | A | 6/1977 | Riffe et al. |
| 4,048,605 | A | 9/1977 | McCollum |
| 4,058,768 | A | 11/1977 | Milkovic |
| 4,096,436 | A | 6/1978 | Cook et al. |
| 4,107,519 | A | 8/1978 | Bicek |
| D249,883 | S | 10/1978 | Collins |
| 4,124,030 | A | 11/1978 | Roberts |
| 4,151,578 | A | 4/1979 | Bell |
| 4,158,217 | A | 6/1979 | Bell |
| 4,158,810 | A | 6/1979 | Leskovar |
| 4,177,496 | A | 12/1979 | Bell et al. |
| 4,198,595 | A | 4/1980 | Milkovic |
| 4,207,604 | A | 6/1980 | Bell |
| 4,215,278 | A | 7/1980 | Barbier et al. |
| 4,227,419 | A | 10/1980 | Park |
| 4,241,237 | A | 12/1980 | Paraskevakos et al. |
| 4,249,264 | A | 2/1981 | Crochet et al. |
| 4,250,449 | A | 2/1981 | Shum |
| 4,253,336 | A | 3/1981 | Pietzuch |
| 4,258,348 | A | 3/1981 | Belfer et al. |
| 4,297,741 | A | 10/1981 | Howell |
| 4,328,903 | A | 5/1982 | Baars |
| 4,354,155 | A | 10/1982 | Speidel et al. |
| 4,359,672 | A | 11/1982 | Hart |
| 4,362,580 | A | 12/1982 | Kane et al. |
| 4,363,061 | A | 12/1982 | Vaerewyck et al. |
| 4,371,814 | A | 2/1983 | Hannas |
| 4,373,392 | A | 2/1983 | Nagamoto |
| 4,384,289 | A | 5/1983 | Stillwell et al. |
| 4,386,280 | A | 5/1983 | Ricaud et al. |
| 4,388,668 | A | 6/1983 | Bell et al. |
| 4,393,714 | A | 7/1983 | Schmidt |
| 4,398,426 | A | 8/1983 | Park et al. |
| 4,408,175 | A | 10/1983 | Nelson et al. |
| 4,413,193 | A | 11/1983 | Crockett |
| 4,413,230 | A | 11/1983 | Miller |
| 4,426,673 | A | 1/1984 | Bell et al. |
| 4,432,238 | A | 2/1984 | Tward |
| 4,475,081 | A | 10/1984 | Kobayashi |
| 4,491,790 | A | 1/1985 | Miller |
| 4,495,463 | A | 1/1985 | Milkovic |
| 4,506,199 | A | 3/1985 | Asche |
| 4,558,310 | A | 12/1985 | Mcallise |
| 4,558,595 | A | 12/1985 | Kompelien |
| 4,574,266 | A | 3/1986 | Valentine |
| 4,605,883 | A | 8/1986 | Cockroft |
| 4,621,532 | A | 11/1986 | Takagi et al. |
| 4,660,407 | A | 4/1987 | Takami et al. |
| 4,709,339 | A | 11/1987 | Fernandes |
| 4,739,229 | A | 4/1988 | Heiler, Jr. |
| 4,746,809 | A | 5/1988 | Coleman et al. |
| 4,754,365 | A | 6/1988 | Kazahaya |
| 4,757,416 | A | 7/1988 | Wilkerson |
| 4,758,962 | A | 7/1988 | Fernandes |
| 4,783,748 | A | 11/1988 | Swarztrauber et al. |
| 4,794,327 | A | 12/1988 | Fernandes |
| 4,808,910 | A | 2/1989 | Kessi |
| D301,331 | S | 5/1989 | Rhodin |
| 4,851,803 | A | 7/1989 | Hahn |
| 4,855,671 | A | 8/1989 | Fernandes |
| 4,874,904 | A | 10/1989 | DeSanti |
| 4,885,655 | A | 12/1989 | Springer et al. |
| 4,887,018 | A | 12/1989 | Libert |
| 4,890,318 | A | 12/1989 | Crane et al. |
| 4,926,105 | A | 5/1990 | Mischenko et al. |
| 4,939,451 | A | 7/1990 | Baran et al. |
| 4,944,187 | A | 7/1990 | Frick et al. |
| 4,956,588 | A | 9/1990 | Ming |
| 5,449,991 | A | 9/1995 | Owen |
| 5,719,546 | A * | 2/1998 | Ito ..... H01F 38/14 336/173 |
| 6,018,239 | A | 1/2000 | Berkcan et al. |
| 6,118,077 | A | 9/2000 | Takeuchi |
| 6,507,261 | B1 | 1/2003 | Haga et al. |
| 6,753,752 | B1 * | 6/2004 | Lin ..... H01F 3/14 336/178 |
| 6,950,292 | B2 | 9/2005 | Holce et al. |
| 7,359,809 | B2 | 4/2008 | Bruno |
| 7,447,603 | B2 | 11/2008 | Bruno |
| 7,969,271 | B2 | 6/2011 | Lai et al. |
| 8,421,443 | B2 | 4/2013 | Bitsch |
| 2005/0127895 | A1 | 6/2005 | Rittmann |
| 2006/0006976 | A1 * | 1/2006 | Bruno ..... H01F 27/263 336/229 |
| 2006/0129339 | A1 | 6/2006 | Bruno |
| 2006/0280921 | A1 * | 12/2006 | Oh ..... H01F 3/14 428/212 |
| 2007/0205750 | A1 | 9/2007 | Yakymyshyn et al. |
| 2010/0207604 | A1 | 8/2010 | Bitsch |
| 2013/0271895 | A1 | 10/2013 | Kuhns |

* cited by examiner

SPLIT CORE CURRENT TRANSFORMER

CROSS-REFERENCE TO RELATED APPLICATIONS

This application claims the benefit of U.S. Provisional App. No. 61/930,830, filed Jan. 23, 2014.

BACKGROUND OF THE INVENTION

The present invention relates to split core current transformer.

It is often desirable to monitor power consumption in the individual branch circuits of a facility as well as the overall energy usage by the facility. Individual branch circuit monitoring not only permits billing for energy consumption by the various consumers, but permits billing to be extended to take into account low power factors or high total harmonic distortion, promoting efficiency by allowing the operator of the facility to determine whether and where capital investment for power quality enhancement equipment would provide the best return on investment. Individual branch circuit monitoring can also indicate conditions in the branch circuit, and trigger alerts in case limits on such parameters as RMS voltage or current, power factors, or harmonic distortion are exceeded.

Currents in each of the branch circuits in a facility are typically measured by connecting a current sensor to sense the current flowing in each of the branch power cables exiting the facility's power distribution panel. Generally, a current sensor comprises a sensing transformer installed on an electrical conductor of interest and an electronic circuit that produces an output representative of the electrical current carried by the conductor. The current sensor may be an individual meter for a single circuit or a networked meter that can be temporarily connected, respectively, to each of a plurality of circuits to periodically and momentarily monitor the current in each circuit.

The typical sensing transformer used to sense the electrical current flowing in a power cable comprises a coil of wire wrapped around the cross-section of a magnetically permeable core that encircles the power cable. A sensing transformer with a hinged, split toroidal core is often used because the transformer can be easily affixed to an installed power cable without disconnecting the power cable from a connected device, such as, a circuit breaker in a distribution panel. Cota, U.S. Pat. No. 5,502,374 discloses a split core sensing transformer comprising a toroidal housing divided into a pair of housing halves. Each half of the housing retains a half of the toroidal core of the transformer. The housing halves are interconnected by a hinge located near one end of each half of the housing. The hinge permits pivoting of the housing halves to separate the ends of the housing halves opposite the hinge. The power conductor is passed between the separated ends of the housing halves and the housing halves are then pivoted together encircling the centrally positioned power conductor with the two halves of the toroidal core. On the ends of the housing halves opposite the hinge, a ridge on one housing half and a matching recess on the other half of the housing form a latch to hold the hinged housing halves closed around the power conductor. While the hinged split core sensing transformer permits encirclement of a connected power cable, the resulting current transfer tends to lose its calibration over time.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
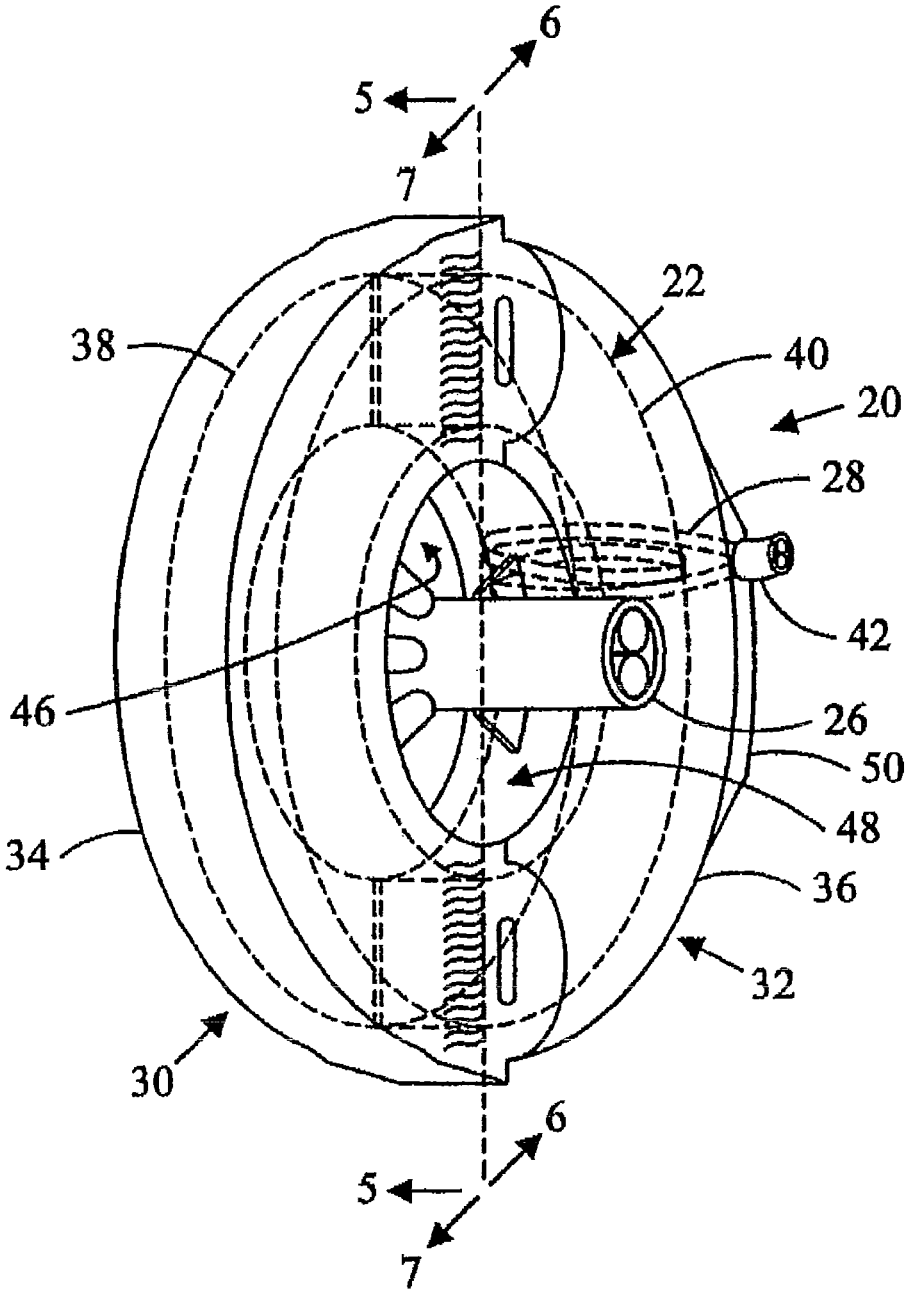
FIG. 1 illustrates a perspective schematic of a split core sensing transformer.

Referring in detail to FIGS. 1-7 where similar parts of the invention are identified by like reference numerals, a sensing transformer 20 comprises a magnetically permeable toroidal core 22 that substantially encircles a power conductor 26 (or more than one power conductor) that is connected to conduct an electrical current to be measured. The core 22 is a ferrous torus typically having a rectangular or circular cross-section. One or more turns of wire 28 (or more than one wire) are wrapped around the cross-section of a sector 24 (indicated by a bracket) of the toroidal core 22.

A changing current (i.e. alternating current) in a power conductor produces a changing magnetic field around the conductor which, in turn, induces a magnetic flux in the magnetically permeable core of a sensing transformer encircling the power conductor. The magnetic flux in the toroidal core induces a current in the wire windings that is representative of the current flowing in the power conductor. Thus, the power conductor is the primary winding and the wire winding is the secondary winding of the sensing transformer. The ends of the wire winding are electrically connected to a burden resistor that converts the current signal received from the secondary winding of the sensing transformer to a voltage signal representing the current flowing in the conductor.

Figure 2:
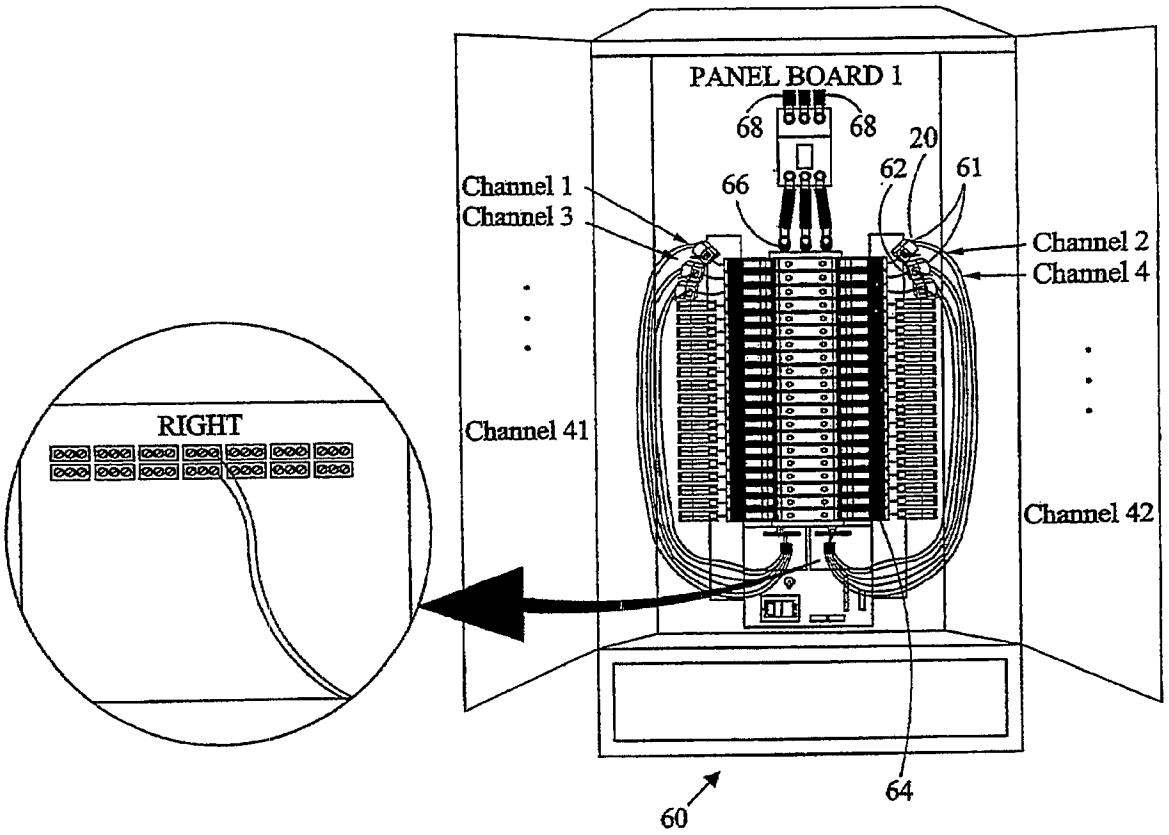
FIG. 2 illustrates a front view of an electrical distribution panel including a plurality of sensing transformers arranged to encircle branch electrical conductors.
Figure 3:
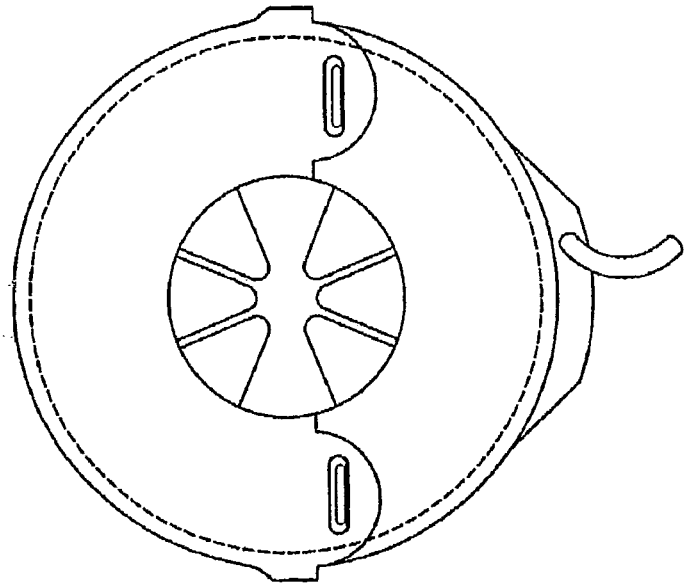
FIG. 3 illustrates a side elevation of a split core sensing transformer.
Figure 4:
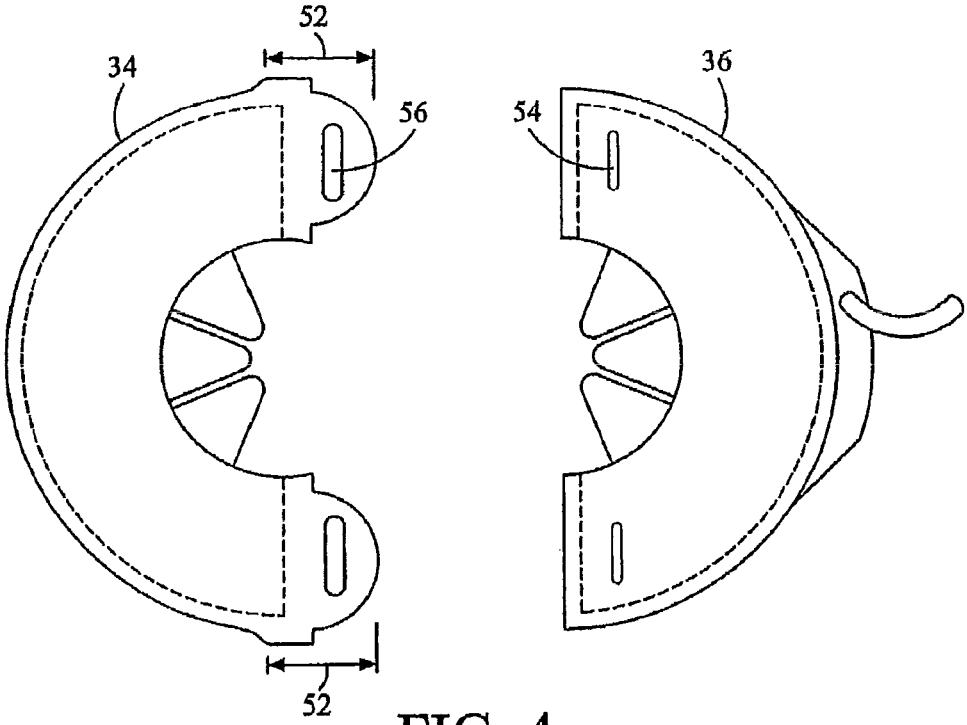
FIG. 4 illustrates a side elevation of the separated segments of the split core sensing transformer of FIG. 3.
Figure 5:
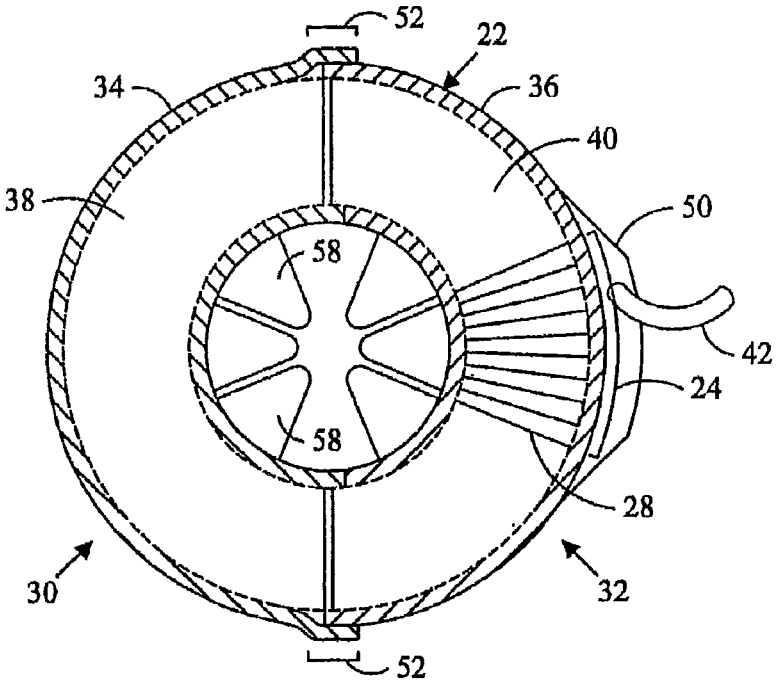
FIG. 5 illustrates a section view of the split core sensing transformer of FIG. 1 taken along line 5-5.
Figures 6, 7:
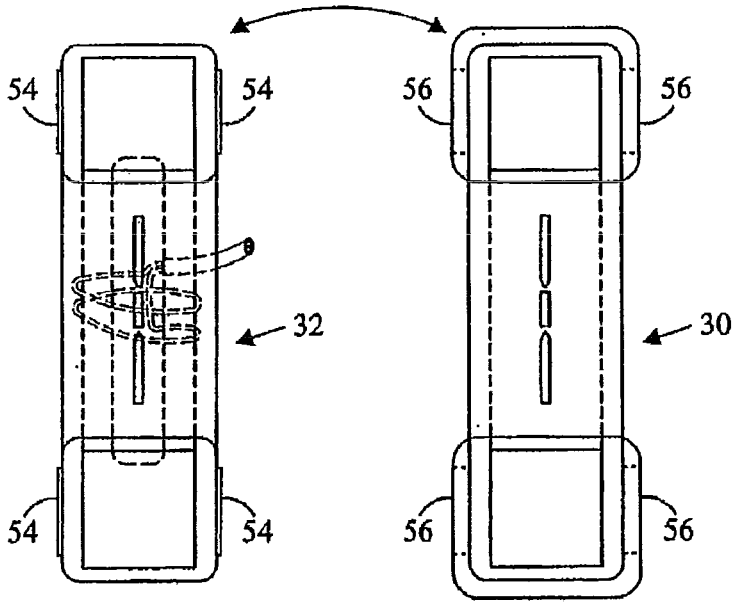
FIG. 6 illustrates a section view of the split core sensing transformer of FIG. 1 taken along line 6-6.
FIG. 7 illustrates a section view of the split core sensing transformer of FIG. 1 taken along line 7-7.

To measure the current in several branch circuits in a facility, sensing transformers are installed on each of the respective branch power conductors. Referring to FIG. 2, the sensing transformers 61 are typically installed on the branch power conductors 62 at the distribution panel 60 where the branch power conductors are connected to circuit breakers 64 that protect the branch circuitry from high current. The plurality of circuit breakers 64 are usually arranged immediately adjacent to each other in the distribution panel and are typically connected to bus bars 66 that are, in turn, connected to the input conductors 68 bringing power from the power grid to the distribution panel.

The branch power conductors 62 are typically attached to the respective circuit breakers 64 by a screw actuated clamp. Disconnecting a plurality of branch power conductors 62 to install encircling sensing transformers is time consuming and requires that power be disconnected from at least the branch circuit in which the transformer is to be installed. A hinged, split core sensing transformer permits the ends of housing halves to be spread apart so that the power conductor can be passed between the spread ends. With the power conductor centrally positioned between the housing halves, the housing halves are pivoted together encircling the power conductor with the toroidal core of the transformer.

Referring to FIGS. 1-7, the split core sensing transformer 20 comprises at least two separable transformer segments 30, 32. Each segment comprises a respective segment housing 34, 36 and a sector of a magnetically permeable toroidal core 38, 40 that, when installed, will substantially encircle an electrical power conductor 26. One or more turns of wire 28 is wrapped around the cross-section of a sector of the toroidal core 22. An alternating current in a conductor 26 passing through the central aperture 48 of the transformer 20 produces a changing magnetic field around the conductor that induces a magnetic flux in the magnetically permeable core 22. The magnetic flux, in turn, induces a current in the wire windings 28 on the core 22. The ends of the wire winding 28 are electrically connected through a cable 42 to a burden resistor (not shown) that converts the current signal received from the wire winding 28 of the sensing transformer 20 to a voltage signal representing the current flowing in the conductor.

The magnetically permeable core 22 comprises a ferrous material and is constructed of sectors 38, 40 that when arranged end-to-end form, substantially, a torus. The core 22 has a planar cross-section bounded by a closed curve that is typically rectangular or circular. The torus is the result of rotating the planar cross-section about an axis that lies in the plane of the cross-section but does intersect the plane of the cross-section. Each sector 38, 40 of the core 22 includes a curved inner surface 46 which will, when the sectors are arranged end-to-end, define the central aperture 48 of the sensing transformer 20. An exemplary sensing transformer includes a toroidal core of 3% silicon steel, grain oriented, with an outside diameter of 1.375 inches, an inside diameter of 1.125 inches, and a depth of 0.50 inches in a direction parallel to the axis about which the cross-section of the torus is rotated.

The sectors of the toroidal core 38, 40 are retained within respective separable housing segments 34, 36 that substantially sheath the cross-section of the toroidal core sectors. The housing segment 36 that encloses the core sector 40 that is wrapped with the wire winding 28 includes an extended portion 50 that encloses the connections of the wire winding to the conductors in the cable 42 that conducts signals from the wire winding to the instrumentation and provides an anchor for the cable.

A substantially tubular projecting portion 52 (indicated by a bracket) of walls of one of the housing segments 30 projects beyond the ends of the sector of the core 38 retained in the housing segment. The projecting portions 52 are enlarged to provide an interior sufficiently large to slidably accept in mating engagement the ends of the housing 36 of the other transformer segment 32. One of the housing segments 36 also includes a raised ridge 54 projecting from either side of the housing adjacent to the ends of the segment. Each of the raised ridges 54 is arranged to engage a corresponding aperture 56 in the wall of the mating housing segment 36 to prevent the engaged segments from separating. The surfaces of the housing segments 30, 32 that define the central aperture of sensing transformer 20 also include a plurality of resiliently flexible triangular fingers 58 projecting radially inward to provide a central opening for the power conductor 26. If the power conductor is larger than the opening provided by the ends of the triangular fingers 58, the fingers will bend resiliently outward to accommodate the power conductor. Typically, the housing is made of an electrically insulating thermoplastic material such as nylon or polyvinyl chloride (PVC).

To install the split core transformer 20 on a power conductor 26, the conductor is positioned between the separated segments 30, 32 of the transformer housing adjacent the surfaces that will form the central aperture 48 of transformer. The cooperating ends of the housing segments 34, 36 are aligned and the segments 30, 32 are pressed into mating engagement. When the housings 34, 36 of the segments 30, 32 are fully engaged, the two sectors 38, 40 of the core substantially encircle the power conductor 26 and the cooperating ridges 54 on the side of the housing of one segment mate with the corresponding apertures 56 in the housing of the other segment. Interference of the ridges 54 with a surface of the apertures 56 resists separation of the segments. The sensing transformer can be removed from the power conductor by inserting a screwdriver or other tool between the segment housings to release the mated ridges and apertures, permitting the segments to be separated. Signals from the sensing transformer are transmitted to the appropriate instrumentation through the cable 42.

The input and output characteristics of current transformers may be manually modified by changing the physical properties of the current transformer until it is within desirable tolerances. Alternatively, the characteristics of the current transformers may be measured and a suitable scaling technique used to calibrate the output to specific values. Similarly, this scaling may be in the form of one or more scaling factors, one or more functions, one or more look up tables, and/or one or more electronic components to tune the calibration. The scaling factors, functions, tables, and/or electronic components may be included together with the current transformer or otherwise provided in association with the current transformer so that suitable initial calibration may be achieved.

Unfortunately, over time the performance of the current transformers tends to drift or otherwise change in an unpredictable manner. As the performance of the current transformer becomes increasingly different, the resulting measurements from the current transformer are likewise less representative of the actual current in the power conductor after initial calibration. When the current measurement becomes sufficiently incorrect, systems relying on this measurement may produce false alarms, power being inappropriately provided or removed to electrical loads, inappropriate financial charges to customers and other systemic failures.

In some cases, it is possible to remove the current transformer from encircling the power conductor and recalibrate it. However, it is dependent on both knowing the device is in need of recalibration, which may not be evident, as well as time consuming to remove the current transformer from the power conductor and may require shutting down associated devices, resulting in substantial disruptions. Typically, such recalibration is performed at the factory and therefore would take several days to obtain a recalibrated current transformer. If the current transformer has sufficiently changed its properties, then it may not be possible to accurately recalibrate the current transformer.

Often current transformers are shipped with a light oil coating on the cores for transport and short term storage of the current transformers. Unfortunately, while such light oil coating would seemingly seem to be appropriate for the long term operation of the current transformer, it turns out that the light oil tends to migrate away from the adjoining surfaces of the halves of a split core transformer. In particular, after the light oil coating migrates away the exposed metal adjoining surfaces of the halves of the split core transformer tend to rust or otherwise corrode. This rusting is particularly prevalent for laminated cores made from steel. This rusting or otherwise corrosion is especially pronounced in hostile environmental conditions, such as for example, a chlorine processing plant. This rusting and/or corrosion is a contributing factor in the reduction in the performance of the current transformer over time. In addition, this rusting tends to result in added air gaps between the halves, which further reduces the performance of the current transformer.

Figure 8:
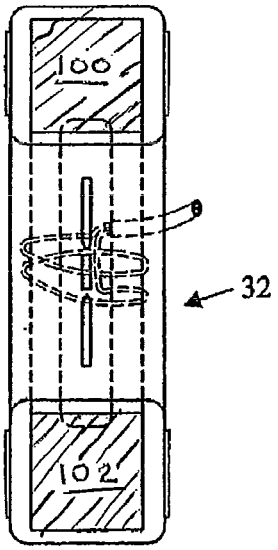
FIG. 8 illustrates a section view of the split core sensing transformer of FIG. 1 taken along line 6-6 together with a conductive coating applied to the ends thereof.
Figure 9:
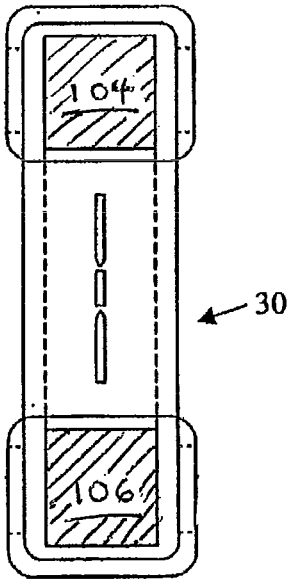
FIG. 9 illustrates a section view of the split core sensing transformer of FIG. 1 taken along line 7-7 together with a conductive coating applied to the ends thereof.

Referring to FIG. 8 and FIG. 9, to decrease the change in the performance of the current transformer, it is desirable to minimize non-linearity in magnetic flux between the two halves of the current transformer while simultaneously reducing the rusting and/or corrosion that tends to occur over time using a conductive coating on the ends 100, 102, 104, 106 of the respective halves of the current transformer. This reduction in changing magnetic flux may be achieved by a coating being included. Moreover, with a coating on the ends of the respective halves of the current transfer the spacing between the cores of the haves is not significantly increased. The coating is preferably applied in such a manner that it is not susceptible to migration over time. As a result of the coating, the effects of aging of the current transformer are substantially reduced.

One technique for an electrically conductive coating on the adjoining faces of the halves of the current transformer is an electroless nickel immersion gold surface plating. This may be formed using an electroless nickel plating covered with a thin layer of immersion gold, which protects the nickel from oxidation. Such a coating tends to have good surface planarity and good oxidation resistance. Alternatively, molten solder may be used, if desired. Other electrically conductive coatings may likewise be included on the ends of the halves of the current transformer, such as for example, a nickel plating, a copper plating, a silver plating, and/or a plating of other electrically conductive or non-conductive materials. Preferably, substantially all (e.g., 75% or more) of all four surfaces of the ends of the haves of the current transformer are coated with the material, while substantially all (e.g., 75% or more) of the remainder of the surface area of the current transformers are not coated with the material. As a result of the electrically conductive coating, the current transformer tends to not change its performance with changes in humidity, temperature, and/or air pressure.

Another technique for a suitable coating on the adjoining faces of the halves of the current transformer, to reduce the changes in the performance, is a magnetically conductive ferrofluid which is a liquid. The ferrofluid may include colloidal liquids made of nanoscale ferromagnetic, or ferrimagnetic, particles suspected in a carrier fluid. Each particle is coated with a surfactant to inhibit clumping. Other magnetically susceptible materials may likewise be used, as desired. Moreover, the improved magnetic conduction decreases the reluctance of the current transformer, so that the current transformer has improved low level performance.

Preferably, the thickness of the coating is as little as possible while still being effective against corrosion. Preferably, the coating is approximately 50 microns thick, and preferably between 15 and 75 microns thick. Preferably, the coating is adhered to the surface of the respective ends of the current transformer. The coating may likewise be applied to current transformers that are not included within an associated housing, and may likewise be applied to one or more of the ends of the current transformer.

The current transformer may be used in combination with the branch current and/or power monitoring system, or any other current and/or voltage sensing system. For purposes of clarity, it is to be understood that the embodiments may be used with any current transformer, and that neither a branch circuit monitor system nor is a branch power monitor system necessary, and that simply a single current transformer of any configuration may be used. The current transformer may be constructed in any suitable manner, such as from solid portions and/or from laminated potions. The current transformer may include two or more portions. For purposes of clarity, it is to be understood that the embodiments may use any current transformer of any configuration and/or shape, such as for example, round, torus, toroidal, square, rectangular, and/or irregular. For purposes of clarity, it is to be understood that the different portions of the current transformer may be any section of the current transformer, having similar sizes or different sizes. For example, a rectangular current transformer may include three sides as a single piece where the fourth side is a single detachable piece from the other single piece. As it may be appreciated, the addition of the coating increases the initial accuracy of the current transformer, increases the long term accuracy of the current transformer, reduce the phase shifts resulting from the current transformer, reduces the changes in the phase shift of the current transformer over time, and/or increases the effective turns of the current transformer. Also, the adjoining ends of the cores halves (or portions) may have any suitable configuration, such as for example, a waffled pattern, a circular pattern, and/or a v-shaped pattern. The housing may be omitted from the cores, if desired. Also, it is to be understood that the current transformer may omit the housing from any of the portions thereof, or may omit the housing in its entirety, as desired.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A sensing transformer comprising:

(a) a first transformer segment including:

(i) a first magnetically permeable core comprising a sector having a planar cross-section bounded by a closed curve and having a first end and a second end;

(ii) a winding including at least one turn substantially encircling said cross-section of said core; and (iii) a first segment housing enclosing said winding and a portion of said first core; and (b) a second transformer segment separable from said first transformer segment, said second transformer segment including:

(i) a second magnetically permeable core comprising a different sector having a third end and a fourth end; and (ii) a second segment housing enclosing a portion of said second core, said second segment housing separable from said first segment housing to enable separation of said first and said second transformer segments and joinable to said first segment housing to restrain said first and said second cores in a substantially closed arrangement with said first end and said third end being adjacent one another and with said second end and said fourth end being adjacent one another when said second housing is said joined to said first housing;

(c) wherein said first end is plated with an electrically conductive material thereon having a thickness between 15 and 75 microns, said second end is plated with an electrically conductive material thereon having a thickness between 15 and 75 microns, said third end is plated with an electrically conductive material thereon having a thickness between 15 and 75 microns, and said fourth end is plated with an electrically conductive material thereon having a thickness between 15 and 75 microns.

2. The sensing transformer of claim 1 wherein said first, second, third, and fourth ends are completely adhered by said material.

3. The sensing transformer of claim 1 wherein said material is less than 50 microns thick.

4. The sensing transformer of claim 1 wherein said material is less than $1/16^{th}$ inch thick.

5. The sensing transformer of claim 1 wherein said material is less than $1/32^{nd}$ inch thick.

6. The sensing transformer of claim 1 wherein said material is less than $1/64^{th}$ inch thick.

7. The sensing transformer of claim 1 wherein said material is nickel.

8. The sensing transformer of claim 1 wherein said material is electroless nickel immersion gold surface plated.

9. The sensing transformer of claim 1 wherein said material is nickel plated.

10. The sensing transformer of claim 1 wherein said material is copper plated.

11. The sensing transformer of claim 1 wherein said material is silver plated.

12. The sensing transformer of claim 1 wherein said material is not substantially covering either of said first core and said second core.

13. A sensing transformer comprising:

(a) a first transformer segment including:

(i) a first magnetically permeable core comprising a sector having a planar cross-section bounded by a closed curve and having a first end and a second end;

(ii) a winding including at least one turn substantially encircling said cross-section of said core; and (iii) a first segment housing enclosing said winding and a portion of said first core; and (b) a second transformer segment separable from said first transformer segment, said second transformer segment including:

(i) a second magnetically permeable core comprising a different sector having a third end and a fourth end; and (ii) a second segment housing enclosing a portion of said second core, said second segment housing separable from said first segment housing to enable separation of said first and said second transformer segments and joinable to said first segment housing to restrain said first and said second cores in a substantially toroidal arrangement with said first end and said third end being adjacent one another and with said second end and said fourth end being adjacent one another when said second housing is said joined to said first housing;

(c) wherein said end is coated with a magnetically conductive ferrofluid material thereon having a thickness between 15 and 75 microns, said second end is coated with a magnetically conductive ferrofluid material thereon having a thickness between 15 and 75 microns, said third end is coated with a magnetically conductive ferrofluid material thereon having a thickness between 15 and 75 microns, and said fourth end is coated with a magnetically conductive ferrofluid material thereon having a thickness between 15 and 75 microns.

14. The sensing transformer of claim 13 wherein said material is less than 50 microns thick.

* * * * *